US006898395B2

(12) United States Patent
Mui et al.

(10) Patent No.: US 6,898,395 B2
(45) Date of Patent: May 24, 2005

(54) MULTIFUNCTION PRINTER WITH INTEGRATED SCANNER/STAPLER

(75) Inventors: Paul K. Mui, Boise, ID (US); Russell A. Mendenhall, Boise, ID (US); Roberto Obregon, Jalisco (MX); Eric L. Andersen, Meridian, ID (US); Wesley A. Fujii, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 46 days.

(21) Appl. No.: 10/459,997

(22) Filed: Jun. 12, 2003

(65) Prior Publication Data

US 2004/0253018 A1 Dec. 16, 2004

(51) Int. Cl.[7] ..... G03G 15/00

(52) U.S. Cl. ..... 399/107; 399/110; 399/408; 399/410

(58) Field of Search ..... 399/107, 110, 399/118, 405, 408, 410

(56) References Cited

U.S. PATENT DOCUMENTS

| | | | | |
|---|---|---|---|---|
| 5,839,025 | A * | 11/1998 | Okauchi et al. | 399/405 |
| 5,899,601 | A * | 5/1999 | Yamaguchi et al. | 399/118 |
| 6,381,442 | B1 | 4/2002 | Okitsu et al. | 399/405 |
| 6,466,753 | B2 * | 10/2002 | Kida | 399/118 |
| 6,735,415 | B2 * | 5/2004 | Isobe et al. | 399/410 |

* cited by examiner

*Primary Examiner*—William J. Royer

(57) ABSTRACT

A multifunction printer apparatus includes a printer, with a printer media path, and a scanner/stapler assembly detachably secured to the printer. The scanner/stapler assembly includes a scanner and a stapler-configured media path that begins at the printer media path and emerges from the scanner/stapler assembly along a direction perpendicular to a feed direction of the scanner.

48 Claims, 4 Drawing Sheets

MULTIFUNCTION PRINTER WITH INTEGRATED SCANNER/STAPLER

BACKGROUND OF THE INVENTION

Multifuntion printers generally embody printing functionality along with copying, facsimile and/or scanning functionality. Some multifunction printers (MFPs) include a paper-handling device mounted on the side of the MFP. A disadvantage of this configuration is that the paper-handling device results in a MFP with an increased footprint that covers an undesirably large amount of desktop space. In other MFP configurations, the paper-handling device is supported between the scanner and the printer by a stand, bracket, or the like. A disadvantage of this configuration is that it undesirably increases the height of the scanner which is problematic in terms of accessibility when the MFP is to be used as a desktop device. This increase in the height of the scanner is also problematic because it increases the distance between the scanner and the MFP control panel, which causes significant usability problems. Such an increase in scanner height also negatively affects the aesthetics of the product. Thus, it would be desirable to be able to provide a MFP that provides both a small footprint and a distance between the scanner and the control panel appropriate for a desktop environment. It would also be desirable to provide easy accessibility to the media input and output trays as well as a stapler cartridge of the MFP. In addition, it would be desirable to provide a MFP configuration that is easier to manufacture, ship and/or service.

BRIEF DESCRIPTION OF THE DRAWINGS

Detailed description of embodiments of the invention will be made with reference to the accompanying drawings.

DETAILED DESCRIPTION

The following is a detailed description for carrying out the invention. This description is not to be taken in a limiting sense, but is made merely for the purpose of illustrating the general principles of the invention.

Figure 1:
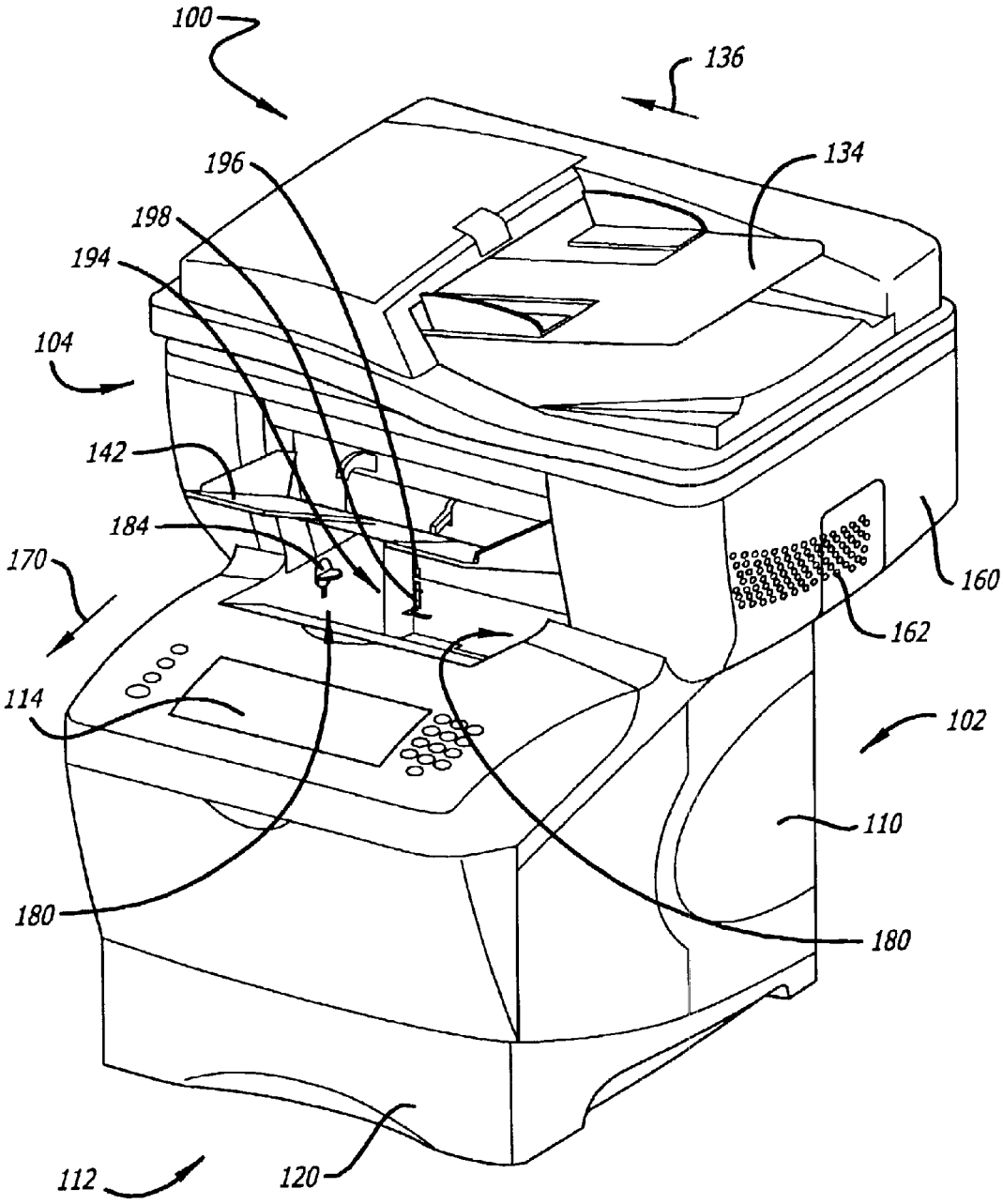
FIG. 1 is a perspective view of a multifunction printer apparatus according to an embodiment of the present invention.
Figure 4:
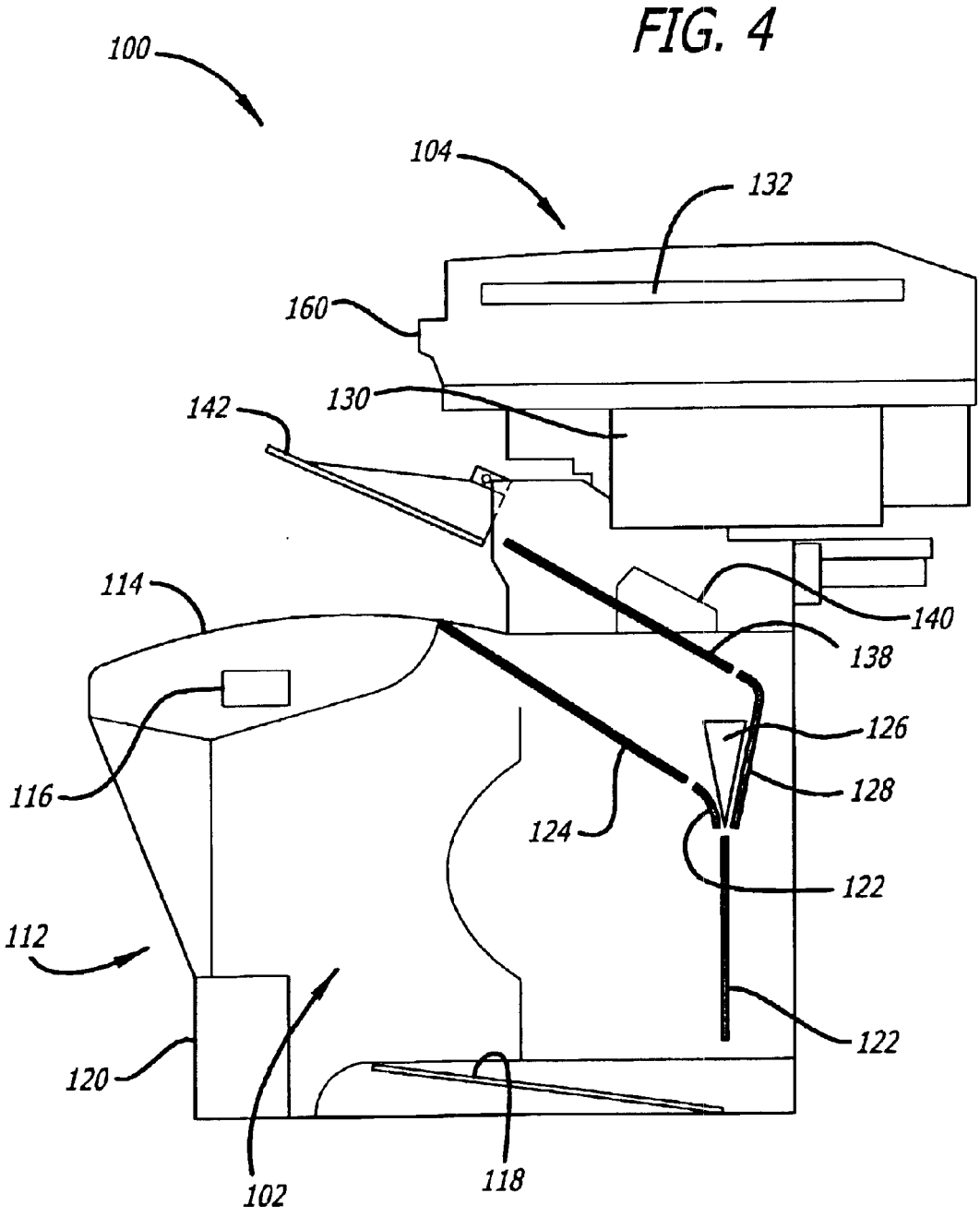
FIG. 4 is cross-sectional side view of the multifunction printer apparatus of FIG. 1.

Referring to FIGS. 1 and 4, a multifunction printer apparatus 100 according to an embodiment of the present invention includes a printer 102 and a scanner/stapler assembly 104. The printer 102 includes a housing 110 with a front side 112. The housing 110 contains components of the printer 102 and, in this example embodiment, is configured to support a control panel 114 adjacent and facing the front side 112. By way of example, the control panel 114 is a touch screen display which functions as a user input mechanism to the printer 102 and, more specifically, to a printer controller 116 inside the housing 110. The control panel 114 allows a user to provide inputs pertaining to copying, printing, scanning, document finishing and other functions of the multifunction printer apparatus 100. Although the printer controller 116 is shown in this example as being positioned within the housing 110, it should be appreciated that the printer controller 116 can also be located outside the housing 110 and/or remotely located relative to the printer 102.

The printer 102 includes a media input tray 118 configured to be accessible from the front side 112 of the printer 102 via a media input tray access door 120. In operation, pieces of media (not shown) are picked from the media input tray 118 and advanced along a printer media path 122 past a printing mechanism (not shown) and then, after printing is completed, are deposited upon a printer output tray 124. Thus, in the illustrated example embodiment, the printer 102 is configured to advance printed media along the printer media path 122, moving the printed media toward a front portion of the printer 102 and onto the printer output tray 124.

In the illustrated example embodiment, the printer 102 also includes a diverter 126 at the printer media path 122. The diverter 126 is configured to direct printed media along either the printer media path 122 or a stapler media path 128, which leads to the scanner/stapler assembly 104. The diverter 126 is activated by a solenoid (not shown) which is controlled by the printer controller 116. Printed media that do not require stapling are directed to the printer media path 122. Printed media that do require stapling are directed to the stapler media path 128. Printed media that do not require stapling can also be directed to the stapler media path 128, for example, when the printer output tray 124 is full (as discussed below in greater detail).

An example embodiment of the scanner/stapler assembly 104 includes a scanner 130 with an automatic document feeder (ADF) 132 and scanner input tray 134 configured as shown. In operation, documents are placed into the scanner input tray 134 and advanced by the ADF 132 along a scanner feed direction (indicated by an arrow 136). The scanner/stapler assembly 104 also includes a stapler media path 138, a stapler 140 adjacent the stapler media path 138, and a stapler output tray 142 at an end portion of the stapler media path 138. In the example embodiment, the scanner 130 is positioned above the stapler media path 138 and above the stapler 140. When the scanner/stapler assembly 104 is secured to the printer 102, the stapler media path 138 of the scanner/stapler assembly 104 begins at the end of the stapler media path 128 of the printer 102. This operative engagement results in the scanner/stapler assembly 104 being configured to advance printed media from the printer 102 along the stapler media path 138, moving the printed media to the stapler 140 and then onto the stapler output tray 142. In the illustrated embodiment, the scanner/stapler assembly 104 is positioned above the printer 102 and above the printer media path 122.

Figure 3:
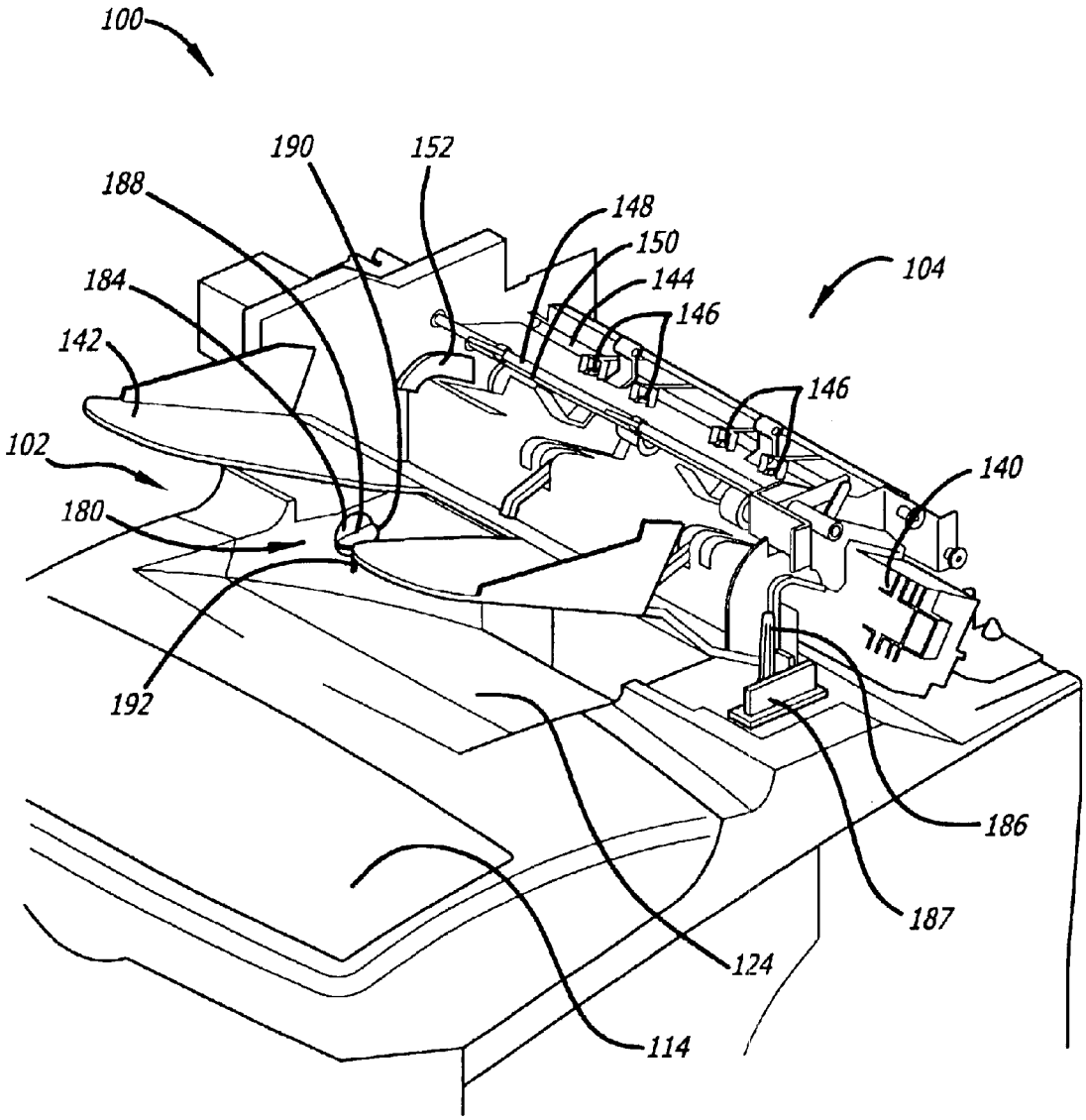
FIG. 3 is an enlarged view of the multifunction printer apparatus of FIG. 1 shown with the scanner and housing portions of the scanner/stapler assembly removed.

Referring to FIG. 3, the scanner/stapler assembly 104 further includes an upper paper guide 144 and idle rollers 146 configured as shown for guiding and advancing printed media toward the stapler output tray 142. In this example configuration, a paddle shaft 148 and a caterpillar shaft 150 respectively control coarse and fine backward motion of the printed media. The scanner/stapler assembly 104 also includes a jogger 152 for aligning edges of sheets of media and pushing an aligned stack of media sheets toward the stapler 140. Other configurations and mechanisms for advancing printed media from the printer 102, along the stapler media path 138, to the stapler 140, and onto the stapler output tray 142 are also within the scope of the present invention.

Referring to FIG. 1, the scanner/stapler assembly 104 includes a housing 160 that holds the scanner/stapler assembly components. In the illustrated example embodiment, the housing 160 includes a stapler access door 162 through which the stapler 140 can be accessed. In this example embodiment, the stapler 140 is fixed in position relative to the stapler media path 138. Alternatively, the stapler 140 can take the form of a multi-position stapler or a sliding stapler.

Figure 2:
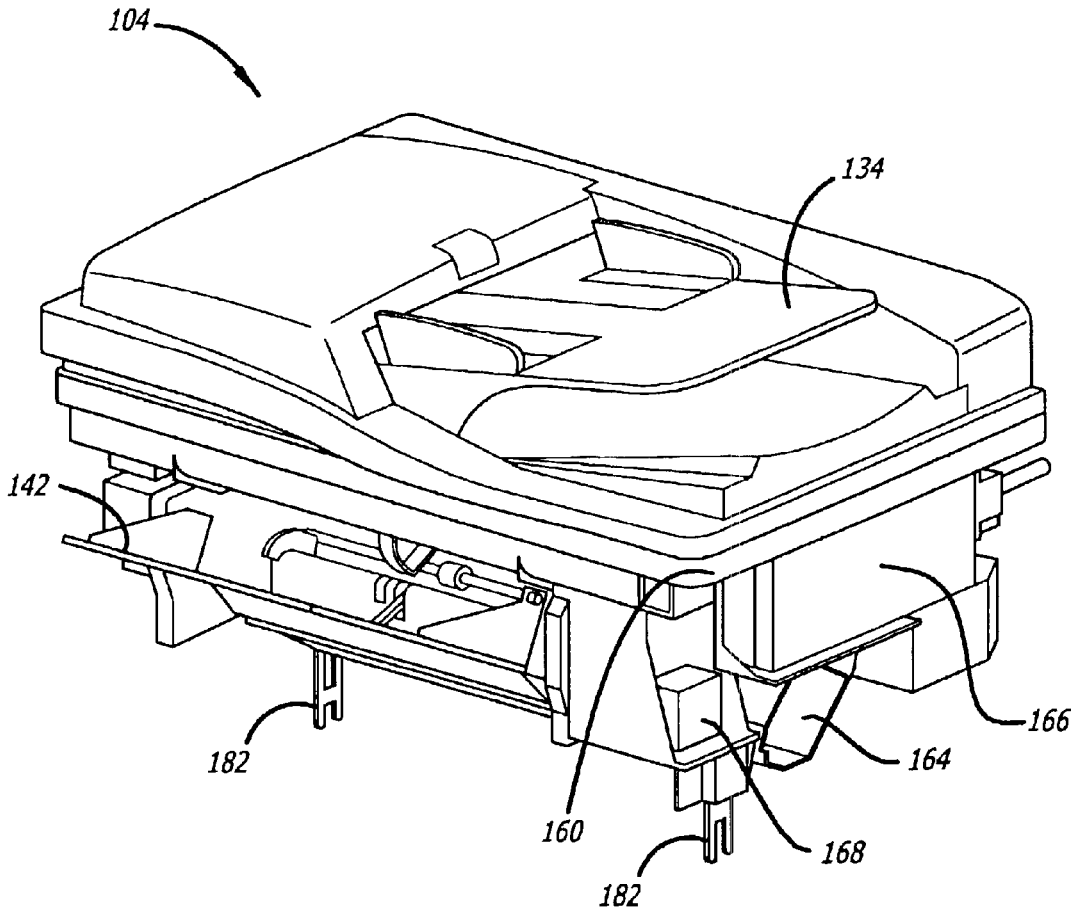
FIG. 2 is a partial cross-sectional perspective view of the scanner/stapler assembly included in the multifunction printer apparatus of FIG. 1.

Referring also to FIG. 2, the scanner/stapler assembly 104 includes a stapler tunnel 164 that opens adjacent the stapler access door 162. The stapler tunnel 164 is configured to hold the stapler 140 and to provide easy access for stapler cartridge replacement. In this example embodiment, the scanner/stapler assembly 104 also includes a scanner/stapler assembly controller 166, e.g., a printed circuit assembly (PCA), positioned within the housing 160. In this example embodiment, the scanner/stapler assembly 104 also includes an electrical connector 168 that provides a signal interface between the scanner/stapler assembly 104 and the printer 102. Although the scanner/stapler assembly controller 166 is shown in this example as being positioned within the housing 160, it should be appreciated that the scanner/stapler assembly controller 166 can also be located outside the housing 160 and/or remotely located relative to the scanner/stapler assembly 104. By way of example, functions controlled by the scanner/stapler assembly controller 166 can be "migrated" to the printer controller 116.

The example embodiment of the scanner/stapler assembly 104 is detachably securable (as described below in greater detail) to the printer 102. Referring to FIG. 1, the scanner/stapler assembly 104 is detachably secured to the printer 102 such that the stapler media path 138 emerges from the scanner/stapler assembly 104 along a direction (indicated by an arrow 170) perpendicular or orthogonal to the feed direction (indicated by the arrow 136) of the scanner 130 or the scanner input tray 134. By virtue of its orientation relative to the printer 102, the scanner/stapler assembly 104 is also detachably secured to the printer 102 such that the feed direction (indicated by the arrow 136) of the scanner 130 or the scanner input tray 134 is perpendicular or orthogonal to the printer media path 122 or the printer output tray 124.

With the scanner/stapler assembly 104 mechanically coupled to the printer 102 as in this example embodiment, the printer media path 122 emerges from the printer 102 along a direction perpendicular to the feed direction of the scanner 130. Moreover, the printer media path 122 emerges from the printer 102 along a direction parallel to the direction that the stapler media path 138 emerges from the scanner/stapler assembly 104. In this example embodiment, the printer output tray 124 is positioned below the stapler output tray 142 and below the stapler media path 138.

When the multifunction printer apparatus 100 is assembled, the scanner/stapler assembly 104 is configured to advance printed media along the stapler media path 138, moving the printed media toward the front portion of the printer 102 and onto the stapler output tray 142. In the illustrated example embodiment, all of the printed media output paths advance printed media toward a front portion of the printer 102. Alternatively, at least one of the printed media output paths advances printed media toward a front portion of the printer 102. In the illustrated example embodiment, the media input tray 118, the printer output tray 124, and the stapler output tray 142 are all accessible from a front side of the printer 102 that faces a direction orthogonal to the feed direction of the scanner input tray 134.

More generally, a multifunction printer apparatus 100 according to an embodiment of the present invention includes at least one printed media output path that is not parallel to a feed direction of the scanner 130. It has been observed that the relative motions of the printer 102 and the scanner 130 (e.g., caused by bumping one or the other) can impact the other causing distortion in the print quality of the printer output and the copy quality of the original scan document. According to the present invention, by avoiding configurations where the printed media output path is parallel to the feed direction of the scanner 130, printer motion has less of an impact on scanner motion and vice versa.

To this end, it is desirable to have the printed media emerge from the scanner/stapler assembly 104 along a direction perpendicular (or at least not parallel) to the feed direction of the scanner 130 because in such a configuration the motion of the scanner 130 has less of an impact on the motion of the printer 102 so that the print quality of the printer output is not affected. Likewise, the motion of the printer 102 has less of an impact on the motion of the scanner 130 so that the copy quality of the original document scan is not affected.

According to various embodiments of the present invention, the printer 102 and/or scanner/stapler assembly 104 includes an interlock mechanism configured to selectively engage the scanner/stapler assembly 104 with the printer 102 or disengage the scanner/stapler assembly 104 from the printer 102. The illustrated example interlock mechanism is configured to allow a person to selectively engage the scanner/stapler assembly 104 with the printer 102 or disengage the scanner/stapler assembly 104 from the printer 102. The illustrated example interlock mechanism is also configured to allow a person to manually engage the scanner/stapler assembly 104 with the printer 102 or disengage the scanner/stapler assembly 104 from the printer 102. Generally, the interlock mechanism functions to mechanically couple the scanner/stapler assembly 104 with the printer 102 or decouple the scanner/stapler assembly 104 from the printer 102.

In the illustrated example embodiment, the multifunction printer apparatus 100 includes a mechanism for detachably securing the scanner/stapler assembly 104 to the printer 102 such that the feed direction of the scanner input tray 134 is perpendicular or orthogonal to the printer media path 122 and/or the stapler media path 138. By way of example, this mechanism includes an interlocking member configured to engage the scanner/stapler assembly 104 with the printer 102 or disengage the scanner/stapler assembly 104 from the printer 102. Referring to FIGS. 1 and 2, in the example embodiment, the printer 102 includes a pair of interlocking mechanisms 180 (only one shown) and the scanner/stapler assembly 104 includes a pair of complementary latch members 182. In the illustrated example embodiment, the interlocking mechanisms 180 are configured to mechanically engage with the latch members 182 and are accessible from a front portion of the printer 102. In the illustrated example embodiment, each of the interlocking mechanisms 180 includes a member 184 configured to actuate the interlock mechanism 180 when the member 184 is repositioned (e.g., rotated) relative to the printer 102.

Referring also to FIG. 3, the illustrated example interlocking mechanisms 180 are configured such that they automatically lock (engage) with the latch members 182 when the scanner/stapler assembly 104 is "dropped in", guided by a pair of alignment pins 186 (only one shown). In this illustrated example, the printer 102 also includes an interconnector 187 positioned such that it interconnects with the electrical connector 168 when the scanner/stapler assembly 104 is guided along the alignment pins 186 and into engagement with the printer 102. By way of example, the interlocking mechanisms 180 include spring lock mechanisms (not shown) configured to perform the automatic locking function.

In the illustrated example embodiment, each of the members 184 is formed to also serve as a manually keyed release mechanism when repositioned relative to the printer 102. For example, each of the members 184 is formed with a turning slot 188 (e.g., sized to receive a coin 190) and configured to be rotatable relative to the printer 102 (e.g., when turned by the coin 190 inserted into the turning slot 188) to a position that manipulates the spring lock mechanism to unlock (disengage) the scanner/stapler assembly 104 from the printer 102. In the illustrated embodiment, each of the interlocking mechanisms 180 also includes a drop slot 192 into which the coins 190 drop after each of the members 184 has been rotated to the position that causes it to unlock (disengage) the scanner/stapler assembly 104 from the printer 102. By way of example, the drop slots 192 are sized such that a coin 190 (e.g., approximately the size of a quarter) will fall partially into the drop slot 192 and remain partially within the turning slot 188 after each of the members 184 has been rotated to the position that causes it to unlock (disengage) the scanner/stapler assembly 104 from the printer 102. This dropping of the coins 190 serves to fix or lock the interlocking mechanisms 180 into their respective interlock disengaged positions which, in turn, frees both hands of the person who turned the coins 190 to lift the released scanner/stapler assembly 104 away from the printer 102. Thus, the afore-described example interlocking mechanisms 180 provide an automatic locking mechanism and a manual unlocking mechanism. It should be appreciated that other interlocking configurations and approaches can be implemented consistent with the principles of the present invention. By way of example, alternative mechanisms for detachably securing the scanner/stapler assembly 104 to the printer 102 include, but are not limited to, screws (and other mechanically interlocking mechanisms), solenoid latching mechanisms, and magnetically actuated latching mechanisms.

By integrating a low profile stapler 140 with a scanner 130 according to the present invention, the footprint of the multifunction printer apparatus 100 is not increased and the distance between the control panel 114 and the scanner input tray 134 remains optimal (or is not significantly increased). Thus, according to an embodiment of the present invention, an accessory for a multifunction printer apparatus 100 includes a detachable scanner/stapler assembly 104 configured to be mechanically coupled to a printer 102 such that a stapler media path 138 of the detachable scanner/stapler assembly 104 mechanically interfaces with a printer media path 122 of the printer 102 and such that a scan feed direction of the scanner/stapler assembly 104 is parallel to a front side 112 of the printer 102 and orthogonal to all printed media output directions of the detachable scanner/stapler assembly 104 and the printer 102. In another embodiment, the detachable scanner/stapler assembly 104 includes a stapler access door 162. In another embodiment, the detachable scanner/stapler assembly 104 includes a stapler output tray 142 at an end portion of the stapler-configured media path 138.

According to an embodiment of the present invention, a method for providing a printer 102 with a scanner/stapler assembly 104 includes the step of detachably securing a scanner/stapler assembly 104 to a printer 102 including input and output media trays 118, 124 that all face a front side 112 of the printer 102 such that a scanner feed direction of a scanner/stapler assembly 104 is transversely oriented relative to directions of media movement out of and into the input and output media trays 118, 124, respectively. In another embodiment, the step of detachably securing the scanner/stapler assembly 104 to the printer 102 includes interlocking the scanner/stapler assembly 104 with the printer 102. In another embodiment, the method further includes the step of electrically interconnecting the scanner/stapler assembly 104 and the printer 102.

Referring to FIG. 1, the example embodiment of the printer 102 also includes a sensor mechanism 194 for detecting the height of a stack of (printed) media in the printer output tray 124. By way of example, the sensor mechanism 194 includes an optical sensor 196 and a mechanical arm 198 configured as shown adjacent the printer output tray 124. As more media is advanced along the printer media path 122 and into the printer output tray 124, the mechanical arm 198 is pushed upward until it eventually blocks the optical sensor 196 and changes an output signal that the optical sensor 196 provides to the printer controller 116. Other sensor configurations can also be employed.

By way of example, the printer controller 116 uses the output signal generated by the optical sensor 196 to divert or reroute a print job (or print jobs) to the stapler output tray 142 when the output signal indicates that a particular amount of media is in the printer output tray 124. More generally, the printer 102 can be configured to selectively divert printed media to one or more of the printed media output paths depending upon information associated with the printed media output trays and/or printed media output paths (i.e., information such as: the numbers of media sheets already directed to the various output trays, an amount of printed media in an output tray, and/or whether the printed media is to be stapled).

Independent of whether an output signal from the sensor mechanism 194 is available, the printer 102 can be configured to divert the printed media depending upon prior usage of the printed media output paths. For example, the printer controller 116 can monitor the number of sheets of media advanced along the various printed media output paths, and divert or reroute a print job (or print jobs) after a particular number of sheets have been advanced along a particular printed media output path.

As discussed above, the printer 102 can also be configured to divert the printed media depending upon whether the printed media is to be stapled. For example, a user input provided at the control panel 114 is used by the printer controller 116 to control the diverter 126 to direct printed media along either the printer media path 122 or the stapler media path 128, and to provide appropriate command signals to the scanner/stapler assembly controller 166 via the signal interface at the electrical connector 168.

Although the present invention has been described in terms of the example embodiments above, numerous modifications and/or additions to the above-described embodiments would be readily apparent to one skilled in the art. It is intended that the scope of the present invention extend to all such modifications and/or additions.

We claim:

1. A multifunction printer apparatus, comprising:

a printer including a printer media path; and a scanner/stapler assembly detachably secured to the printer, the scanner/stapler assembly including a scanner, a stapler media path and a stapler adjacent the stapler media path, the stapler media path beginning from the printer media path and emerging from the scanner/stapler assembly along a direction perpendicular to a feed direction of the scanner.

2. The multifunction printer apparatus of claim 1, wherein the printer includes an interlock mechanism configured to allow a person to engage the scanner/stapler assembly with the printer or disengage the scanner/stapler assembly from the printer.

3. The multifunction printer apparatus of claim 1, wherein the printer includes a printer output tray positioned below the stapler media path.

4. The multifunction printer apparatus of claim 1, wherein the scanner/stapler assembly includes a stapler output tray at an end portion of the stapler media path, and the printer includes a printer output tray positioned below the stapler output tray.

5. The multifunction printer apparatus of claim 1, wherein the printer includes a printer output tray and a diverter at the printer media path, the diverter being configured to direct printed media along either the printer media path or the stapler media path.

6. The multifunction printer apparatus of claim 1, wherein the printer includes a printer output tray and is configured to advance printed media along the printer media path, moving the printed media toward a front portion of the printer and onto the printer output tray.

7. The multifunction printer apparatus of claim 1, wherein the scanner/stapler assembly includes a stapler output tray and is configured to advance printed media along the stapler media path, moving the printed media toward a front portion of the printer and onto the stapler output tray.

8. The multifunction printer apparatus of claim 1, wherein the printer media path emerges from the printer along a direction perpendicular to the feed direction of the scanner.

9. The multifunction printer apparatus of claim 1, wherein the printer media path emerges from the printer along a direction parallel to the direction that the stapler media path emerges from the scanner/stapler assembly.

10. The multifunction printer apparatus of claim 1, wherein the scanner/stapler assembly includes a stapler access door.

11. The multifunction printer apparatus of claim 1, wherein the scanner/stapler assembly is positioned above the printer.

12. The multifunction printer apparatus of claim 1, wherein the scanner/stapler assembly is positioned above the printer media path.

13. The multifunction printer apparatus of claim 1, wherein the scanner is positioned above the stapler media path.

14. The multifunction printer apparatus of claim 1, wherein the scanner is positioned above the stapler.

15. A multifunction printer apparatus, comprising:

a printer including a printer media path;

a scanner/stapler assembly including a scanner with a scanner input tray and a stapler media path with a stapler; and means for detachably securing the scanner/stapler assembly to the printer such that a feed direction of the scanner input tray is orthogonal to the printer media path.

16. The multifunction printer apparatus of claim 15, further comprising:

a connector providing an electrical interface between the printer and the scanner/stapler assembly.

17. The multifunction printer apparatus of claim 15, wherein the printer includes a printer input tray accessible from a front side of the printer that faces a direction orthogonal to the feed direction of the scanner input tray.

18. The multifunction printer apparatus of claim 15, wherein the printer includes a printer output tray accessible from a front side of the printer that faces a direction orthogonal to the feed direction of the scanner input tray.

19. The multifunction printer apparatus of claim 15, wherein the scanner/stapler assembly includes a stapler output tray accessible from a front side of the printer that faces a direction orthogonal to the feed direction of the scanner input tray.

20. The multifunction printer apparatus of claim 19, wherein the printer includes a printer output tray positioned below the stapler output tray.

21. The multifunction printer apparatus of claim 15, wherein the stapler media path begins adjacent and continues from the printer media path.

22. The multifunction printer apparatus of claim 15, wherein the printer includes a diverter at the printer media path, the diverter being configured to direct printed media along either the printer media path or the stapler media path.

23. The multifunction printer apparatus of claim 15, wherein the scanner/stapler assembly is positioned above the printer.

24. The multifunction printer apparatus of claim 15, wherein the scanner/stapler assembly is positioned above the printer media path.

25. The multifunction printer apparatus of claim 15, wherein the scanner is positioned above the stapler.

26. The multifunction printer apparatus of claim 15, wherein the scanner/stapler assembly includes a stapler access door.

27. The multifunction printer apparatus of claim 15, wherein the scanner is positioned above the stapler media path.

28. The multifunction printer apparatus of claim 15, wherein the means for detachably securing the scanner/stapler assembly to the printer includes an interlocking member configured to engage the scanner/stapler assembly with the printer or disengage the scanner/stapler assembly from the printer.

29. A multifunction printer apparatus, comprising:

a printer with a detachable scanner/stapler assembly that together provide a plurality of printed media output paths including a stapler-configured media output path perpendicular to a scanner feed direction of the detachable scanner/stapler assembly, the printer being configured to selectively divert printed media to one or more of the printed media output paths depending upon information associated with the printed media output paths.

30. The multifunction printer apparatus of claim 29, wherein the detachable scanner/stapler assembly is mechanically coupled to the printer with an interlock mechanism.

31. The multifunction printer apparatus of claim 30, wherein the interlock mechanism is accessible from a front portion of the printer.

32. The multifunction printer apparatus of claim 31, wherein the interlock mechanism includes a member configured to actuate the interlock mechanism when the member is repositioned relative to the printer.

33. The multifunction printer apparatus of claim 32, wherein the member is rotatable relative to the printer.

34. The multifunction printer apparatus of claim 30, wherein the interlock mechanism is configured to selectively engage the detachable scanner/stapler assembly with the printer or disengage the detachable scanner/stapler assembly from the printer.

35. The multifunction printer apparatus of claim 30, wherein the interlock mechanism is configured to allow a person to manually engage the detachable scanner/stapler assembly with the printer or disengage the detachable scanner/stapler assembly from the printer.

36. The multifunction printer apparatus of claim 29, wherein the printer is configured to divert the printed media depending upon prior usage of the printed media output paths.

37. The multifunction printer apparatus of claim 29, wherein the printer is configured to divert the printed media in response to a sensor signal.

38. The multifunction printer apparatus of claim 37, wherein the sensor signal indicates an amount of printed media in an output tray.

39. The multifunction printer apparatus of claim 29, wherein the printer is configured to divert the printed media depending upon whether the printed media is to be stapled.

40. The multifunction printer apparatus of claim 29, wherein at least one of the printed media output paths advances printed media toward a front portion of the printer.

41. The multifunction printer apparatus of claim 29, wherein all of the printed media output paths advance printed media toward a front portion of the printer.

42. An accessory for a multifunction printer apparatus that includes a printer with a front side and a printer media path, the accessory comprising:

a detachable scanner/stapler assembly configured to be mechanically coupled to the printer such that a stapler-configured media path of the detachable scanner/stapler assembly mechanically interfaces with the printer media path of the printer and such that a scan feed direction of the scanner/stapler assembly is parallel to the front side of the printer and orthogonal to all printed media output directions of the detachable scanner/stapler assembly and the printer.

43. The accessory for a multifunction printer apparatus of claim 42, wherein the detachable scanner/stapler assembly includes a stapler access door.

44. The accessory for a multifunction printer apparatus of claim 42, wherein the detachable scanner/stapler assembly includes a stapler output tray at an end portion of the stapler-configured media path.

45. A method for providing a printer with a scanner/stapler assembly, comprising the steps of:

detachably securing a scanner/stapler assembly to a printer;

inserting an item of scan media into the scanner/stapler assembly along a scan direction; and directing an item of print media through the printer along a direction transverse to the scan direction.

46. The method for providing a printer with a scanner/stapler assembly of claim 45, wherein the step of detachably securing the scanner/stapler assembly to the printer includes:

interlocking the scanner/stapler assembly with the printer.

47. The method for providing a printer with a scanner/stapler assembly of claim 45, further including the step of:

electrically interconnecting the scanner/stapler assembly and the printer.

48. A multifunction printer apparatus, comprising:

a printer including a printer media path; and a scanner/stapler assembly detachably secured to the printer, the scanner/stapler assembly including a scanner, a stapler media path and a stapler adjacent the stapler media path, the stapler media path beginning from the printer media path and emerging from the scanner/stapler assembly along a direction that is not parallel to a feed direction of the scanner.

* * * * *